United States Patent [19]

Griffin

[11] Patent Number: 4,458,505

[45] Date of Patent: Jul. 10, 1984

[54] SUCTION LINE ACCUMULATOR

[75] Inventor: Gary E. Griffin, Penn Yan, N.Y.

[73] Assignee: Parker-Hannifin Corporation, Cleveland, Ohio

[21] Appl. No.: 478,969

[22] Filed: Mar. 25, 1983

[51] Int. Cl.[3] ..... F25B 43/00

[52] U.S. Cl. ..... 62/503; 29/158; 55/191

[58] Field of Search ..... 62/503; 29/158; 55/191

[56] References Cited

U.S. PATENT DOCUMENTS

| | | | |
|---|---|---|---|
| 3,643,465 | 2/1972 | Bottum | 62/503 |
| 3,837,177 | 9/1974 | Rockwell et al. | 62/503 |
| 3,938,353 | 2/1976 | Wrenn, Jr. et al. | 62/503 |
| 4,182,136 | 1/1980 | Morse | 62/503 |
| 4,208,887 | 6/1980 | Morse et al. | 62/503 |
| 4,231,230 | 11/1980 | Gratzer et al. | 62/503 |

*Primary Examiner*—Ronald C. Capossela
*Attorney, Agent, or Firm*—Joseph B. Balazs

[57] ABSTRACT

A suction accumulator for air conditioning systems and the like consists of a tubular casing with brazed end caps, one of which has inlet and outlet fittings therein which support both ends of a U-shaped conduit within the casing. Inlet and outlet apertures in the conduit and a deflector therebetween to isolate the apertures and direct fluid flow are formed by notching the conduit and cutting and deforming the opposite side to provide a baffle. The ends of the conduit are of different diameters so that a predetermined orientation of the conduit and the apertures therein can be assured within the casing.

7 Claims, 3 Drawing Figures

SUCTION LINE ACCUMULATOR

BACKGROUND OF THE INVENTION

This invention relates to accumulators for air conditioner and refrigerant systems and the like and more particularly to an improved U-tube type accumulator and method of assembling same.

The function of an accumulator is well established in refrigerant systems. Essentially it consists of a device for modifying the flow of fluid in the system and for preventing liquid slugs from reaching the compressor. A typical connection for an accumulator is between the evaporator coil and the compressor in the system whereby the suction line of the compressor draws fluid through the system at fairly high velocities.

In transporting fluid flow through an accumulator, the fluid preferably is directed against the inner wall of a container and is caused to circulate about the inner periphery of same. In so doing, velocity of the fluid is reduced to a great extent and further any liquid contained in the flow is encouraged to cling to the side wall and drain to the lower portion of the container. From this location liquid can be reintroduced to the stream of fluid flow at a controlled rate, typically being achieved by the provision of a metering orifice located at the bottom of the container.

In many conventional accumulators fluid flow is directed through a container or casing in a tubular conduit which includes an opening at the upper end of the container and which is routed through the lower end, having a metering orifice at the lower end for controlled pick up or reentry of liquid to the flow of fluid. U-tubes or J-shaped tubes are typically employed in one form of prior art device as shown for example in U.S. Pat. No. 3,643,465. In this form of accumulator an inlet tube is also employed with an orifice and deflector formed therein by cutting and stamping the side wall of the tube into engagement with the opposite wall. It is apparent in this form of accumulator that the inlet tube and J-tube must be properly oriented within the structure in order to achieve a desired flow of fluid therein and to prevent splashing or other flow of liquid directly to the outlet J-tube.

Another form of prior art device which utilizes tubular conduit in an accumulator structure is shown in U.S. Pat. No. 4,231,230 wherein a single straight tube which includes inlet and outlet openings with a diverter therebetween is disposed in a generally tubular accumulator structure. This in-line type structure requires a separate part to be supplied as the diverter and does not provide a tangential, helical flow of fluid within the container which is considered to be a superior expedient for modification of the flow.

SUMMARY OF THE INVENTION

This invention provides an accumulator of the U-tube variety which has a minimal number of components therein and which can only be assembled in a predetermined, desired configuration. A single U-shaped tubular conduit is used to direct fluid flow in the accumulator. The conduit is notched near one end and the side opposite thereto is cut and stamped to form an inlet opening and a diverter. The latter directs fluid flow out the notch and the tube is bent so that when disposed in a casing the flow is tangential to the inner wall of the casing. The conduit is received in inlet and outlet fittings, being structurally coded so that only one orientation is possible, assuring that the conduit is properly connected and that the flow is tangential within the casing. A metering orifice and filter screen are included at the bend in the conduit for pickup of liquid into the flow stream.

Manufacture of the accumulator is facilitated by the minimal number of components. An initial braze is performed upon the conduit at a relatively high temperature to seal and secure the diverter and the filter screen. Thereafter the conduit may be supported in the fittings located in one end cap, the end caps fitted to a tubular casing and the structure subjected to a further brazing operation at a lower temperature, whereby the entire assembly is completed.

DESCRIPTION OF THE PREFERRED EMBODIMENT

Figure 1:
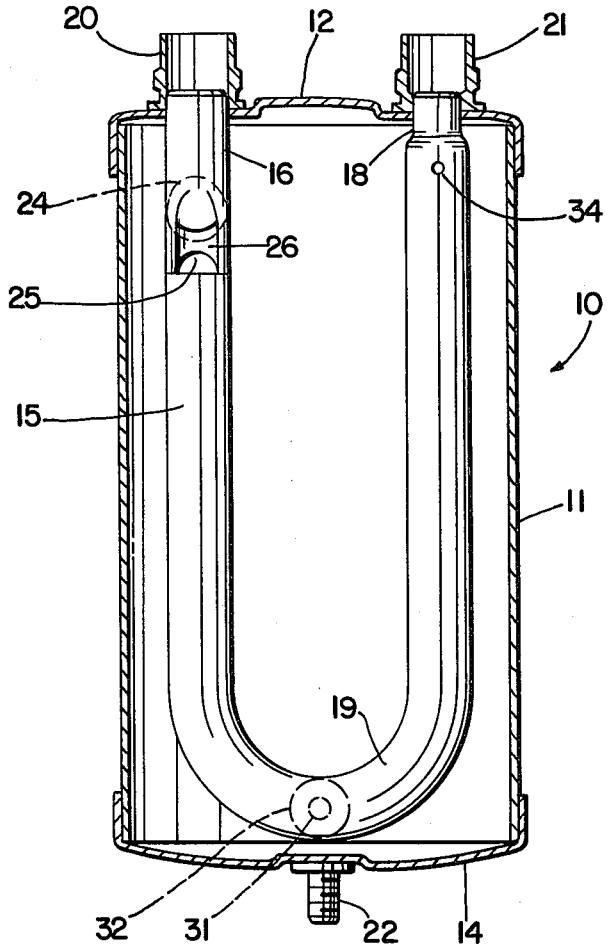
FIG. 1 is a partial sectional side view of an assembled accumulator showing the U-tube, the inlet opening therein and the diverter formed from the material removed to create the inlet opening.

Referring now to the drawings, there is shown the accumulator 10 of the invention which consists of a tubular casing 11 having upper end cap 12, lower end cap 14 and U-tube conduit 15 therein. Substantially all of the components of the accumulator 10 are of steel construction and are suited for production-line assembly by brazing operations.

Conduit 15 is formed of tubular steel and includes first end 16, necked-down second end 18 and bend portion 19 therebetween. The conduit 15 is of a length to extend substantially the full distance of the casing 11, between the end caps 12, 14.

Figure 2:
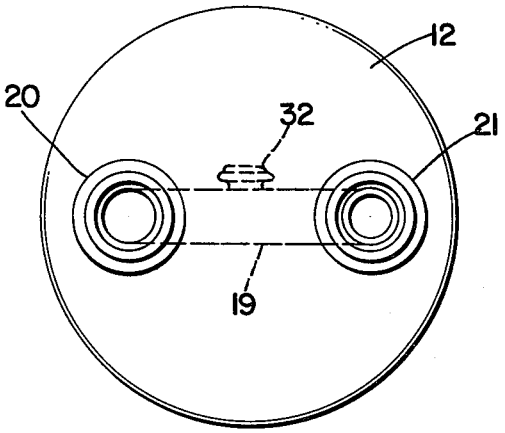
FIG. 2 is a top view of the accumulator of FIG. 1.

The end caps 12, 14 are steel stampings of generally cup-like configuration adapted to be snugly received on tubular casing 11. Upper cap 12 has diametral openings therein and receives inlet fitting 20 and outlet fitting 21 both of which are initially staked in place in the end cap 12, and eventually brazed thereto in a fluid tight connection. Inlet fitting 20 is typically adapted for connection to the evaporator coil of an air conditioner or refrigerant system while outlet fitting 21 is adapted for connection to the suction side of a compressor in the system. As may be seen in FIGS. 1 and 2 the inner end of inlet fitting 20 is larger than the inner end of outlet fitting 21, each being sized to receive respectively the first and second ends 16, 18 of conduit 15. As noted, first end 16 of conduit 15 may only be received in the inlet fitting 20, such coding of fittings 20, 21 assuring that the conduit 15 is disposed in a predetermined orientation within casing 11. Lower cap 14 includes threaded stud 22 thereon for purposes of mounting accumulator 10 in an upright position.

Figure 3:
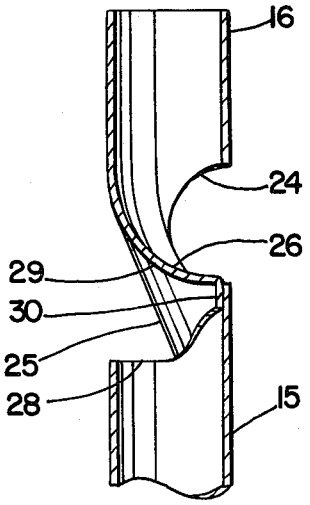
FIG. 3 is an enlarged sectional view of a part of the U-tube of FIG. 1, showing one end thereof, the outlet and inlet openings and the diverter therebetween.

Conduit 15 also includes therein outlet opening 24, inlet opening 25 and diverter 26. As best seen in FIG. 3 openings 24, 25 are positioned between the first end 16 of conduit 15 and the bend portion 19 and preferably outlet opening 24 is spaced only a short distance from upper end cap 12. Diverter 26 and inlet opening 25 are disposed immediately below outlet opening 24 with diverter 26 forming a part of the respective openings 24, 25.

In prior art devices an inlet opening may be positioned at various places within an accumulator housing depending upon the care exercised in the assembly and manufacture thereof. In this invention, inlet opening 25 is located at a predetermined position within casing 11 and with respect to outlet opening 24. In this manner consistent, repeatable results are obtained from the accumulator structure and an optimum flow pattern can be maintained.

Outlet opening 24 is formed by notching conduit 15 by a circular mill or the like to form the semi-circular opening as seen in FIG. 3. Opening 24 extends approximately one-half the diameter of conduit 15. Inlet opening 25 is positioned on the diametral opposite side of conduit 15 and slightly below the outlet opening. Inlet opening 25 is formed by slotting conduit 15 transverse to its longitudinal axis along arcuate edge 28 to a depth of approximately one-half the diameter of conduit 15, and then bending or deforming the conduit wall 29 directly above edge 28 into the conduit 15 into engagement with the opposite wall. This operation is best performed in a stamping of the conduit wall 29 and results in a slightly arcuate diverter 26 extending from one side of the conduit 15 to the opposite side thereof. Preferably, diverter 26 is sufficiently long to extend fully to the opposite wall and may include a small flange 30 thereon and fully closes conduit 15 between the inlet and outlet openings to prevent flow of fluid therethrough.

Thus refrigerant fluid flowing into the first end 16 of conduit 15 impinges against diverter 26 and is directed out of outlet opening 24 and out of conduit 15 in a direction generally transverse to the longitudinal axis of conduit 15.

After formation of openings 24, 25 conduit 15 is bent into the U-shape depicted, defining a plane in which conduit 15 lies. Diverter 26 is arranged to substantially lie in a plane parallel with the plane of conduit 15, and the openings 24, 25 disposed so that the flow of fluid therethrough is generally transverse of the plane of conduit 15. In this manner, with conduit 15 disposed along a diamter of casing 11 and outlet opening 24 adjacent the inner periphery thereof, fluid flow, as directed by diverter 26, will be generally tangential to casing 11 as will return flow from the opposite direction to inlet opening 25. With such complete separation of inlet and outlet openings fluid flow will be required to complete at least a full revolution within casing 11 before being returned to inlet opening 25. In fact, fluid within the casing 11 will traverse a generally helical path down the sidewall of casing 11, ensuring maximum separation of liquid therein and a draining thereof to the bottom of casing 11.

Conduit 15 includes as well conventional metering orifice 31 having filter screen 32 disposed thereover located in the bend portion 19 of conduit 15 and orifice 34 near the necked-down second end 18 of conduit 15. Orifice 34 is provided to prevent siphoning during idle periods while metering orifice 31 provides a measured return of liquid from the bottom of casing 11 to the fluid flowing through conduit 15.

In assembly of the structure of accumulator 10, after formation of the U-tube conduit 11 as described, filter screen 32 is brazed to conduit 11 in a high temperature braze operation. During this same operation diverter 26 is brazed to the wall of conduit 11, as at flange 30 to provide a fluid tight engagement. Thereafter, the now-complete U-tube conduit 11 may be fitted in the appropriate fittings 20, 21, the latter having been staked into upper end cap 12, and the end caps 12, 14 assembled to casing 11. With the provisions of suitable braze material at joints to be fused, the entire structure may be subjected to a brazing operation to join the components into an integral structure. This final braze operation is completed at a lower temperature so as not to affect the previously brazed filter screen 32 and diverter 26.

In this accumulator structure increased usable space is achieved within casing 11 over prior art devices due to the minimum of components required. This additional volume is helpful in achieving a more complete separation of liquid from the refrigerant vapor. Further, inlet opening 24 may be placed as high as desired within casing 11 since no bends of tubing are required as in some prior art devices. Still further, a very rigid structure is provided in this integral minimal component design, which provides superior vibration or fatigue resistant characteristics.

I claim:

1. A suction accumulator, comprising a tubular casing having upper and lower end caps, first and second fittings in said upper end cap for connection to an air conditioner system or the like, said fittings being secured to said end cap and in communication with the interior of said casing, one of said fittings being of larger diameter than said other fitting, a U-shaped tubular conduit having first and second ends and an intermediate bend portion, said conduit being of a length to extend substantially the full length of said casing between said upper and lower end caps, said first and second ends being received respectively in said first and second fittings, one of said ends being of larger diameter than said other end so as to be received only in said larger diameter fitting and to support said conduit in a predetermined position in said casing, inlet and outlet openings in said conduit between one said end thereof and said bend portion, and a diverter between said openings for preventing fluid flow in said conduit between said openings and for directing fluid flow through said outlet opening, said openings and said diverter being formed by notching one side of said conduit and cutting and deforming the opposite side into engagement with said one side to position said openings on opposite sides of said conduit and to provide paths for fluid flow through said openings in a direction generally transverse of a plane in which said conduit is disposed.

2. The accumulator set forth in claim 1 wherein said fittings are in diametrically opposite positions in said upper end cap and said conduit is disposed diametrically in said casing, thereby to provide fluid flow through said openings generally tangentially of said casing.

3. The accumulator set forth in claim 2 wherein said outlet opening is spaced a short distance from said upper end cap and said diverter and said inlet opening are located immediately therebelow, said diverter forming a part of both said inlet and outlet openings.

4. The accumulator set forth in claim 3 wherein said diverter is formed by a transverse diametral cut through said one wall of said conduit and deformation of said wall to said opposite wall and wherein said diverter is brazed to said opposite wall to assure a fluid tight junction therewith.

5. The accumulator set forth in claim 1 wherein said conduit is brazed into said end fittings and said end caps are brazed to said casing to provide an integral structure.

6. The accumulator set forth in claim 5 further including a metering orifice in the bend portion of said conduit and a filter screen brazed in place over said orifice.

7. The accumulator set forth in claim 6 wherein assembly is made by initially forming said conduit structure having said diverter and said filter screen brazed in place with a high temperature braze material, provisionally supporting said fittings in said end cap, said conduit in said fittings and said end caps on said casing, together with lower temperature braze material, whereby said accumulator is completed in a single brazing operation.

* * * * *